US008998383B2

(12) United States Patent
North

(10) Patent No.: US 8,998,383 B2
(45) Date of Patent: Apr. 7, 2015

(54) INKJET NOZZLE DEVICE WITH SYMMETRICALLY CONSTRAINED BUBBLE FORMATION

(71) Applicant: Memjet Technology Ltd., Dublin (IE)

(72) Inventor: Angus John North, North Ryde (AU)

(73) Assignee: Memjet Technology Ltd. (IE)

( * ) Notice: Subject to any disclaimer, the term of this patent is extended or adjusted under 35 U.S.C. 154(b) by 0 days.

(21) Appl. No.: 14/497,731

(22) Filed: Sep. 26, 2014

(65) Prior Publication Data

US 2015/0035907 A1 Feb. 5, 2015

Related U.S. Application Data

(63) Continuation of application No. 14/310,353, filed on Jun. 20, 2014.

(60) Provisional application No. 61/859,889, filed on Jul. 30, 2013.

(51) Int. Cl.
*B41J 2/14* (2006.01)
*B41J 2/16* (2006.01)

(52) U.S. Cl.
CPC ..... *B41J 2/14032* (2013.01); *B41J 2/14088* (2013.01)

(58) Field of Classification Search
CPC ..... B41J 2/14032; B41J 2/14088; B41J 2/04525; B41J 2/04526; B41J 2/0555
USPC ..... 347/20, 44, 47, 54, 56, 61–65, 67, 347/92–94
See application file for complete search history.

(56) References Cited

U.S. PATENT DOCUMENTS

| | | | | |
|---|---|---|---|---|
| 5,463,413 | A * | 10/1995 | Ho et al. | 347/65 |
| 6,491,377 | B1 | 12/2002 | Cleland et al. | |
| 7,464,465 | B2 * | 12/2008 | Silverbrook | 29/890.1 |
| 2009/0096839 | A1 | 4/2009 | Olbrich et al. | |
| 2009/0267990 | A1 | 10/2009 | Lee et al. | |

OTHER PUBLICATIONS

International Search Report and Written Opinion for PCT/EP2014/063462 issued Aug. 26, 2014, 8 pages.

* cited by examiner

*Primary Examiner* — Juanita D Jackson
(74) *Attorney, Agent, or Firm* — Cooley LLP

(57) ABSTRACT

An inkjet nozzle device for symmetrically constrained bubble formation includes: a firing chamber having and an end wall, opposite sidewalls and a nozzle aperture defined in a roof thereof; a baffle plate positioned between the sidewalls of the firing chamber, such that a pair of firing chamber entrances are defined between side edges of the baffle plate and the sidewalls; and an elongate heating element bonded to a floor of the firing chamber, the heater element extending longitudinally between the baffle plate and the end wall. The baffle plate is wider than the heater element. Further, a centroid of the heater element coincides with a midpoint between the baffle plate and the end wall.

13 Claims, 3 Drawing Sheets

INKJET NOZZLE DEVICE WITH SYMMETRICALLY CONSTRAINED BUBBLE FORMATION

RELATED APPLICATION

This is a continuation of prior application Ser. No. 14/310,353, filed Jun. 20, 2014, entitled "INKJET NOZZLE DEVICE HAVING HIGH DEGREE OF SYMMETRY", which is hereby incorporated in its entirety by reference herein.

FIELD OF THE INVENTION

This invention relates to inkjet nozzle devices for inkjet printheads. It has been developed primarily to improve droplet ejection trajectories and minimize fluidic crosstalk between devices, whilst maximizing chamber refill rates.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a nozzle chamber having a nozzle aperture and an actuator for ejecting ink through the nozzle aperture. The design space for inkjet nozzle devices is vast and a plethora of different nozzle devices have been described in the patent literature, including different types of actuators and different device configurations.

One of the most important criteria in designing an inkjet nozzle device is achieving ink drop trajectories perpendicular to the nozzle plane. If each drop is ejected perpendicularly outward, the tail following the drop will not catch and deposit on the nozzle edge. A source of flooding and drop misdirection is thus avoided. Additionally, with perpendicular trajectories, the primary satellite formed by breakup of the drop tail can be made to land on top of the main drop on the page, hiding that satellite. Significant improvements in print quality can thus be obtained with perpendicular drop trajectories.

Memjet® inkjet printers are thermal devices, comprising heater elements which superheat ink to generate vapor bubbles. The expansion of these bubbles forces ink drops through the nozzle apertures. To ensure perpendicular trajectories for these drops, the bubbles must expand symmetrically. This requires symmetry in the design of the nozzle device.

Perfect fluidic symmetry around the heater element is not possible unless the heater element is suspended directly over the inlet to the nozzle chamber. Inkjet nozzle devices having this arrangement are described in, for example, U.S. Pat. No. 6,755,509, and a printhead comprising such a device is shown in U.S. Pat. No. 7,441,865 (see, for example, FIG. 21B), the contents of which are herein incorporated by reference. However, devices having a heater element suspended over the chamber inlet require relatively complex fabrication methods and are less robust than devices having bonded heater elements. Furthermore, these devices suffer from a relatively high rate of backflow through the chamber inlet during ink ejection (resulting in inefficiencies), as well as potential printhead face flooding during chamber refilling by virtue of the alignment of the inlet and the nozzle aperture.

U.S. Pat. No. 7,857,428 describes an inkjet printhead comprising a row of nozzle chambers, each nozzle chamber having a sidewall entrance which is supplied with ink from a common ink supply channel extending parallel with the row of nozzle chambers. The ink supply channel is supplied with ink via a plurality of inlets defined in a floor of the channel. The entrance to each nozzle chamber may comprise a filter structure (e.g. a pillar) for filtering air bubbles or particulates entrained in the ink. The arrangement described in U.S. Pat. No. 7,857,428 provides redundancy in the supply of ink to the nozzle chambers, because all nozzle chambers in the same row (or pair of rows) are supplied with ink from the common ink supply channel extending parallel therewith. However, the arrangement described in U.S. Pat. No. 7,857,428 suffers from the disadvantages of relatively slow chamber refill rates and fluidic crosstalk between nearby nozzle chambers.

In addition, the arrangement described in U.S. Pat. No. 7,857,428 inevitably introduces a degree of asymmetry into droplet ejection compared to the arrangement described in U.S. Pat. No. 6,755,509. Since the heater element is laterally bounded by the chamber sidewalls except for the chamber entrance, the bubble generated by the heater element is distorted by this asymmetry. In other words, some of the impulse generated by the bubble tends to force some ink back through the chamber entrance as well as through the nozzle aperture. This results in skewed droplet ejection trajectories as well as a reduction in efficiency.

One measure for addressing the asymmetry caused by a sidewall chamber entrance is to lengthen and/or narrow the chamber entrance to increase its fluidic resistance to backflow. However, this measure is not viable in high-speed printers, because it inevitably reduces chamber refill rates due to the increased flow resistance. An alternative measure which compensates for the asymmetry caused by a sidewall chamber entrance is to offset the heater element from the nozzle aperture, as described in U.S. Pat. No. 7,780,271 (the contents of which is incorporated herein by reference).

It would be desirable to provide an inkjet nozzle device, which has a high degree of symmetry so as to minimize the extent of any compensatory measures required for correcting droplet ejection trajectories. It would further be desirable to provide an inkjet nozzle device having a high chamber refill rate, which is suitable for use in high-speed printing. It would further be desirable to provide an inkjet printhead having minimal fluidic crosstalk between nearby nozzle devices.

SUMMARY OF THE INVENTION

In accordance with the present invention, there is provided an inkjet nozzle device comprising a main chamber having a floor, a roof and a perimeter wall extending between the floor and the roof, the main chamber comprising:

a firing chamber having a nozzle aperture defined in the roof and an actuator for ejection of ink through the nozzle aperture;

an antechamber for supplying ink to the firing chamber, the antechamber having a main chamber inlet defined in the floor; and a baffle structure partitioning the main chamber to define the firing chamber and the antechamber, the baffle structure extending between the floor and the roof, wherein the firing chamber and the antechamber have a common plane of symmetry.

Inkjet nozzle devices according to the present invention have a high degree of symmetry, which, as foreshadowed above, is essential for minimizing skewed droplet ejection trajectories. The high degree of symmetry is provided, firstly, by alignment of the nozzle aperture, the actuator, the baffle structure and the main chamber inlet along the common plane of symmetry to give perfect mirror symmetry about this axis (nominally the y-axis of the device). Hence, there is negligible skewing of ejected droplets along the x-axis.

Secondly, the baffle structure and an end portion of the perimeter wall are positioned to constrain bubble expansion equally along the y-axis during droplet ejection. Therefore, the positioning of the baffle structure effectively provides a high degree of mirror symmetry about an orthogonal x-axis of the firing chamber. Any skewing of droplet trajectories resulting from backflow through the baffle structure during droplet ejection will either be so small as to not require correction; or will require only small y-offset of the nozzle aperture, as described in U.S. Pat. No. 7,780,271, for correction to non-skewed ejection trajectories. (Whether or not a small y-offset correction is required may depend on factors, such as droplet volume, droplet ejection velocity, ink type, print quality requirements etc). From the foregoing, it will be appreciated that the inkjet nozzle device of the present invention has the advantages of excellent droplet ejection trajectories and, excellent efficiency (in terms of energy transfer from the bubble impulse into droplet ejection).

A further advantage of the inkjet nozzle device according to the present invention is a relatively high chamber refill rate compared to the devices described in U.S. Pat. No. 7,857,428. Since the antechamber receives ink via the floor inlet, which is typically connected to a much wider ink supply channel at the backside of the chip, each nozzle device effectively has direct access to a bulk ink supply. By contrast, in the arrangement described in U.S. Pat. No. 7,857,428, each nozzle chamber receives ink from the relatively narrow ink supply channel defined in the MEMS layer, which can become starved of ink in certain circumstances (e.g. full bleed printing or very high-speed printing). Starvation of the ink supply channel in the MEMS layer leads to poor chamber refill rates, a consequent reduction in print quality and accelerated actuator failure caused by actuators firing with empty or partially-empty nozzle chambers.

A further advantage of the present invention is that each nozzle device is effectively fluidically isolated from nearby devices by virtue of the perimeter wall of the main chamber. The perimeter wall is typically a solid, continuous wall enclosing the main chamber and is absent any interruptions or openings. Hence, with only a floor inlet into the antechamber, there is a tortuous fluidic path between nearby devices. This, in combination with the advantageous reduction in backflow by virtue of the device geometry described above, minimizes the possibility of any fluidic crosstalk between nearby devices. By contrast, the arrangement of nozzle devices described in U.S. Pat. No. 7,857,428 suffers from fluidic crosstalk via the sidewall chamber entrances and the adjoining MEMS ink supply channel.

These and other advantages of the inkjet nozzle device according to the present invention will be readily apparent from the detailed description below.

Preferably, the baffle structure comprises a single baffle plate. Preferably, the baffle plate has a pair of side edges such that a gap extends between each side edge and the perimeter wall to define a pair of firing chamber entrances flanking the baffle plate, the firing chamber entrances being disposed symmetrically about the common plane of symmetry.

The baffle plate advantageously mirrors, as far as possible, an opposite end wall of the firing chamber. Hence, the baffle plate and the opposite end wall provide a similar reaction force to the bubble impulse during droplet ejection, notwithstanding the firing chamber entrances flanking the baffle plate.

Preferably, the baffle plate is wider than the heater element. The width dimension is defined along the nominal x-axis of the main chamber. Preferably, the baffle plate occupies at least 30%, at least 40% or at least 50% of the width of the main chamber. Typically, the baffle plate occupies about half the width of the main chamber, with the firing chamber entrances flanking the baffle plate on either side thereof. The baffle plate usually has a width dimension (along the x-axis), which is greater than a thickness dimension (along the y-axis). Typically, the width of the baffle plate is at least two times greater or at least three time greater than the thickness of the baffle plate.

Preferably, the nozzle aperture is elongate having a longitudinal axis aligned with the plane of symmetry. Preferably, the nozzle aperture is elliptical having a major axis aligned with the plane of symmetry.

In a preferred embodiment, the actuator comprises a heater element. In general, the present invention has been described in connection with a heater element actuator, in accordance with this preferred embodiment. However, it will be appreciated that the advantages of the present invention may be realized with other types of actuator, such as a piezo actuator as is well known in the art or a thermal bend actuator, as described in U.S. Pat. No. 7,819,503, the contents of which are herein incorporated by reference. In particular, symmetric constraint of a pressure wave in the firing chamber using the chamber geometry described herein may be advantageously implemented with other types of actuator.

The actuator may be bonded to the floor of the firing chamber, bonded to the roof of the firing chamber or suspended in the firing chamber. Preferably, the actuator comprises a resistive heater element bonded to the floor of the chamber.

Preferably, the heater element is elongate having a longitudinal axis aligned with the plane of symmetry. Preferably, the heater element is rectangular.

In one embodiment, a centroid of the nozzle aperture is aligned with a centroid of the heater element. However, in an alternative embodiment, a centroid of the nozzle aperture may be offset from a centroid of heater element along the longitudinal axis of the heater element. This y-offset may be used to correct for any residual asymmetry about the x-axis of the firing chamber.

Preferably, the heater element extends longitudinally from the baffle structure to the perimeter wall. Advantageously, a bubble propagating along the length of the heater element is constrained substantially equally by the perimeter wall and the baffle structure, and therefore expands symmetrically.

Preferably, the perimeter wall and baffle plate are staked over respective electrodes for the heater element.

Preferably, the perimeter wall and the baffle structure are comprised of a same material, typically by virtue of being co-deposited during fabrication of the device. The perimeter wall and baffle structure may be defined via an additive MEMS process, in which the material is deposited into openings defined in a sacrificial scaffold (see, for example, the additive MEMS fabrication process described in U.S. Pat. No. 7,857,428, the contents of which are herein incorporated by reference). Alternatively, the perimeter wall and baffle structure may be defined via a subtractive MEMS process, in which the material is deposited as a blanket layer and then etched to define the perimeter wall and baffle structure (see, for example, the subtractive MEMS fabrication process described in U.S. Pat. No. 7,819,503, the contents of which are herein incorporated by reference). For ease of fabrication, excellent roof planarity and robustness, and greater control of chamber height, the perimeter wall and baffle structure are preferably defined by a subtractive process similar to the process described in connection with FIGS. 3 to 5 of U.S. Pat. No. 7,819,503.

The perimeter wall and the baffle structure may be comprised of any suitable material, including polymers (e.g. epoxy-based photoresists, such as SU-8) and ceramics. Preferably, the perimeter wall and baffle structure are comprised of a material selected from the group consisting of: silicon oxide, silicon nitride and combinations thereof.

Likewise, the roof may be comprised of any suitable material, including the polymers and ceramics. The roof may be comprised of a same material as the perimeter wall and baffle structure, or a different material. Typically, a nozzle plate spans across a plurality of nozzle devices in a printhead to define the roofs of each nozzle device. The nozzle plate may be uncoated or coated with a hydrophobic coating, such as a polymer coating, using a suitable deposition process (see, for example, the nozzle plate coating process described in U.S. Pat. No. 8,012,363, the contents of which are herein incorporated by reference).

Preferably, the main chamber is generally rectangular in plan view. Preferably, the perimeter wall comprises a pair of longer sidewalls parallel with the plane of symmetry and a pair of shorter sidewalls perpendicular to the plane of symmetry.

Preferably, a first shorter sidewall defines an end wall of the firing chamber and a second shorter sidewall defines an end wall of the antechamber.

The firing chamber and antechamber may have any suitable relative volumes. The firing chamber may have a larger volume than the antechamber, a smaller volume than the antechamber or a same volume as the antechamber. Preferably, the firing chamber has a larger volume than the antechamber.

The present invention further provides an inkjet printhead or a printhead integrated circuit comprising a plurality of inkjet nozzle devices as described above.

Preferably, the printhead comprises a plurality of ink supply channels extending longitudinally along a backside thereof, wherein at least one row of main chamber inlets at a frontside of the printhead meets with a respective one of the ink supply channels. Preferably, each ink supply channel has a width dimension of at least 50 microns or at least 70 microns. Preferably, each ink supply channel is at least two times, at least three times or at least four times wider than the main chamber inlets.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
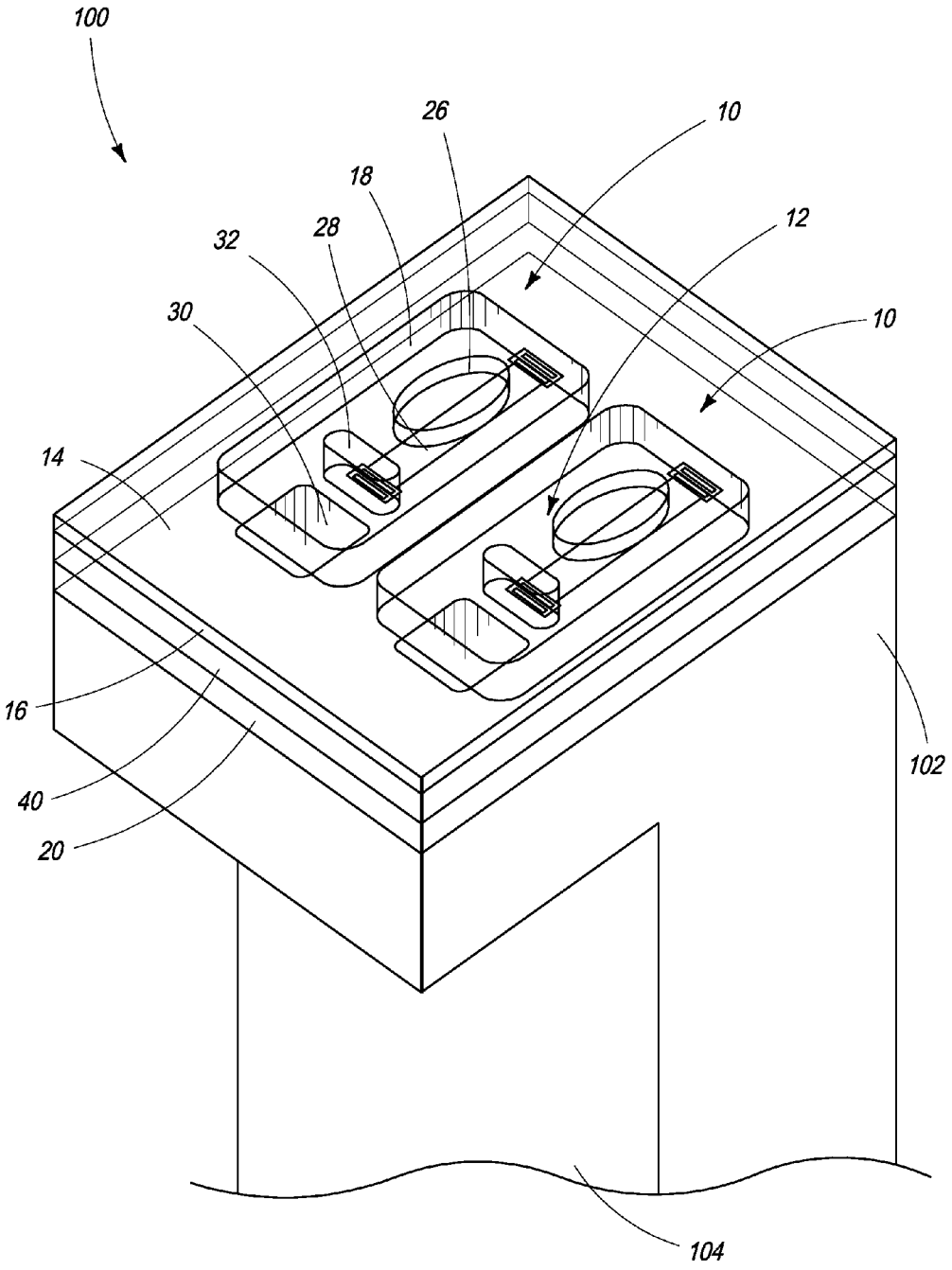
FIG. 1 is a cutaway perspective view of part of a printhead according to the present invention.
Figure 2:
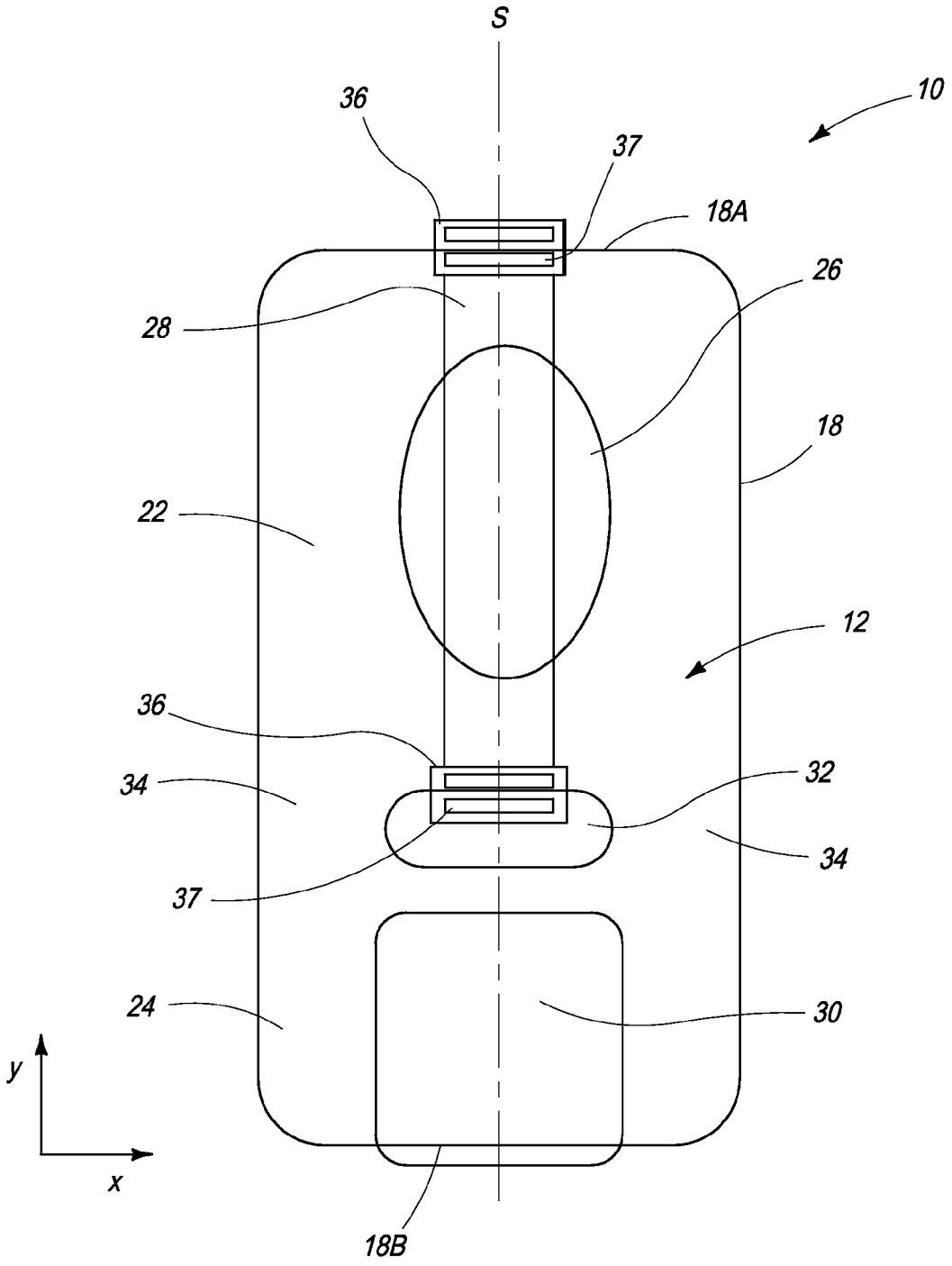
FIG. 2 is a plan view of an inkjet nozzle device according to the present invention.
Figure 3:
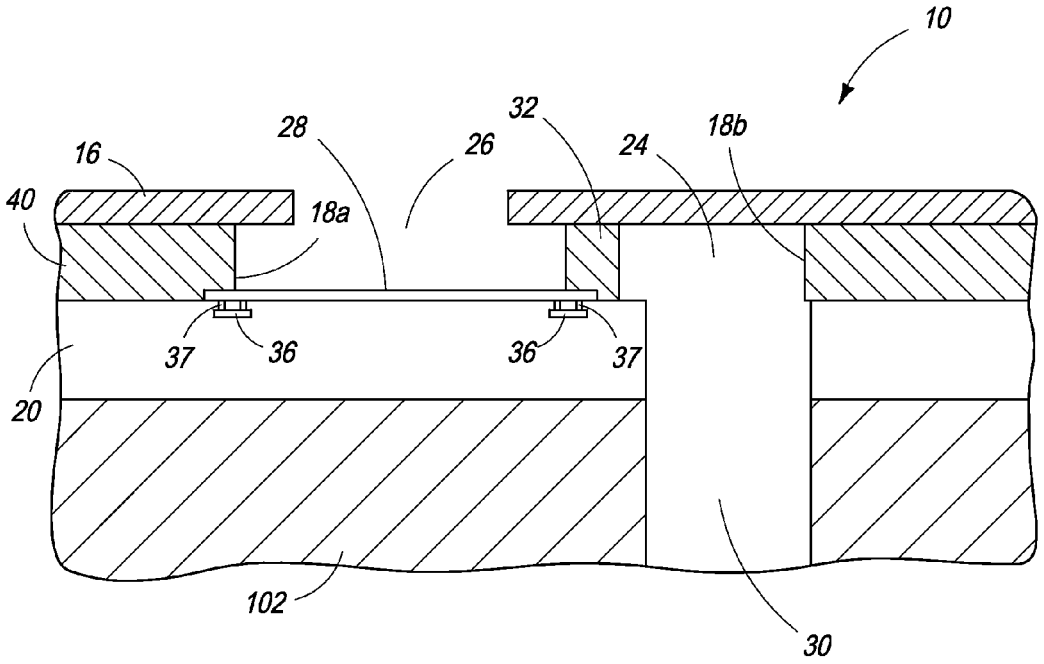
FIG. 3 is a sectional side view of one of the inkjet nozzle devices shown in FIG. 1.

Referring to FIGS. 1 to 3, there is shown an inkjet nozzle device 10 according to the present invention. The inkjet nozzle device comprises a main chamber 12 having a floor 14, a roof 16 and a perimeter wall 18 extending between the floor and the roof. Typically, the floor is defined by a passivation layer covering a CMOS layer 20 containing drive circuitry for each actuator of the printhead. FIG. 1 shows the CMOS layer 20, which may comprise a plurality of metal layers interspersed with interlayer dielectric (ILD) layers.

In FIG. 1 the roof 16 is shown as a transparent layer so as to reveal details of each nozzle device 10. Typically, the roof 16 is comprised of a material, such as silicon dioxide or silicon nitride.

Referring now to FIG. 2, the main chamber 12 of the nozzle device 10 comprises a firing chamber 22 and an antechamber 24. The firing chamber 22 comprises a nozzle aperture 26 defined in the roof 16 and an actuator in the form of a resistive heater element 28 bonded to the floor 14. The antechamber 24 comprises a main chamber inlet 30 ("floor inlet 30") defined in the floor 14.

The main chamber inlet 30 meets and partially overlaps with an endwall 18B of the antechamber 24. This arrangement optimizes the capillarity of the antechamber 24, thereby encouraging priming and optimizing chamber refill rates.

A baffle plate 32 partitions the main chamber 12 to define the firing chamber 22 and the antechamber 24. The baffle plate 32 extends between the floor 14 and the roof 16. As shown most clearly in FIG. 3, the side edges of the baffle plate 32 are typically rounded, so as to minimize the risk of roof cracking (Sharp angular corners in the baffle plate 32 tend to concentrate stress in the roof 16 and increase the risk of cracking).

The nozzle device 10 has a plane of symmetry extending along a nominal y-axis of the main chamber 12. The plane of symmetry is indicated by the broken line S in FIG. 2 and bisects the nozzle aperture 26, the heater element 28, the baffle plate 32 and the main chamber inlet 30.

The antechamber 24 fluidically communicates with the firing chamber 22 via a pair of firing chamber entrances 34 which flank the baffle plate 32 on either side thereof. Each firing chamber entrance 34 is defined by a gap extending between a respective side edge of the baffle plate 32 and the perimeter wall 18. Typically, the baffle plate 32 occupies about half the width of the main chamber 12 along the x-axis, although it will be appreciated that the width of the baffle plate may vary based on a balance between optimal refill rates and optimal symmetry in the firing chamber 22.

The nozzle aperture 26 is elongate and takes the form of an ellipse having a major axis aligned with the plane of symmetry S. The heater element 28 takes the form of an elongate bar having a central longitudinal axis aligned with the plane of symmetry S. Hence, the heater element 28 and elliptical nozzle aperture 26 are aligned with each other along their y-axes.

As shown in FIG. 2, the centroid of the nozzle aperture 26 is aligned with the centroid of the heater element 28. However, it will be appreciated that the centroid of the nozzle aperture 26 may be slightly offset from the centroid of the heater element 28 with respect to the longitudinal axis of the heater element (y-axis). Offsetting the nozzle aperture 26 from the heater element 28 along the y-axis may be used to compensate for the small degree of asymmetry about the x-axis of the firing chamber 22. Nevertheless, where offsetting is employed, the extent of offsetting will typically be relatively small (e.g. less than 1 micron).

The heater element 28 extends between an end wall 18A of the firing chamber 22 (defined by one side of the perimeter wall 18) and the baffle plate 32. The heater element 28 may extend an entire distance between the end wall 18A and the baffle plate 32, or it may extend substantially the entire distance (e.g. 90 to 99% of the entire distance) as shown in FIG. 2. If the heater element 28 does not extend an entire distance between the end wall 18A and the baffle plate 32, then a centroid of the heater element 28 still coincides with a midpoint between the end wall 18A and the baffle plate 32 in order to maintain a high degree of symmetry about the x-axis of firing chamber 22. In other words a gap between the end wall 18A and one end of the heater element 28 is equal to a gap between the baffle plate 32 and the opposite end of the heater element.

The heater element 28 is connected at each end thereof to respective electrodes 36 exposed through the floor 14 of the main chamber 12 by one or more vias 37. Typically, the electrodes 36 are defined by an upper metal layer of the CMOS layer 20. The heater element 28 may be comprised of, for example, titanium-aluminium alloy, titanium aluminium nitride etc. In one embodiment, the heater 28 may be coated with one or more protective layers, as known in the art. Suitable protective layers include, for example, silicon nitride, silicon oxide, tantalum etc.

The vias 27 may be filled with any suitable conductive material (e.g. copper, aluminium, tungsten etc.) to provide electrical connection between the heater element 28 and the electrodes 36. A suitable process for forming electrode connections from the heater element 28 to the electrodes 36 is described in U.S. Pat. No. 8,453,329, the contents of which are incorporated herein by reference.

In some embodiments, at least part of each electrode 36 is positioned directly beneath an end wall 18A and baffle plate 32 respectively. This arrangement advantageously improves the overall symmetry of the device 10, as well as minimizing the risk of the heater element 28 delaminating from the floor 14.

As shown most clearly in FIG. 1, the main chamber 12 is defined in a blanket layer of material 40 deposited onto the floor 14 by a suitable etching process (e.g. plasma etching, wet etching, photo etching etc.). The baffle plate 32 and the perimeter wall 18 are defined simultaneously by this etching process, which simplifies the overall MEMS fabrication process. Hence, the baffle plate 32 and perimeter wall 18 are comprised of the same material, which may be any suitable etchable ceramic or polymer material suitable for use in printheads. Typically, the material is silicon dioxide or silicon nitride.

Referring back to FIG. 2, it can be seen that the main chamber 12 is generally rectangular having two longer sides and two shorter sides. The two shorter sides define end walls 18A and 18B of the firing chamber 22 and the antechamber 24, respectively, while the two longer sides define contiguous sidewalls of the firing chamber and antechamber. Typically, the firing chamber 22 has a larger volume than the antechamber 24.

A printhead 100 may be comprised of a plurality of inkjet nozzle devices 10. The partial cutaway view of the printhead 100 in FIG. 1 shows only two inkjet nozzle devices 10 for clarity. The printhead 100 is defined by a silicon substrate 102 having the passivated CMOS layer 20 and a MEMS layer containing the inkjet nozzle devices 10. As shown in FIG. 1, each main chamber inlet 30 meets with an ink supply channel 104 defined in a backside of the printhead 100. The ink supply channel 104 is generally much wider than the main chamber inlets 30 and effectively a bulk supply of ink for hydrating each main chamber 12 in fluid communication therewith. Each ink supply channel 104 extends parallel with one or more rows of nozzle devices 10 disposed at a frontside of the printhead 100. Typically, each ink supply channel 104 supplies ink to a pair of nozzle rows (only one row shown in FIG. 1 for clarity), in accordance with the arrangement shown in FIG. 21B of U.S. Pat. No. 7,441,865.

The advantages of the nozzle device configuration shown in FIGS. 1 to 3 are realized during droplet ejection and subsequent chamber refilling. When the heater element 28 is actuated by a firing pulse from drive circuitry in the CMOS layer 20, ink in the vicinity of the heater element is rapidly superheated and vaporizes to form a bubble. As the bubble expands, it produces a force ("bubble impulse"), which pushes ink towards the nozzle aperture 26 resulting in droplet ejection. In the absence of the baffle plate 32, the bubble would expand asymmetrically as described in U.S. Pat. No. 7,780,271. Asymmetric bubble expansion occurs when one end of the expanding bubble is constrained by a reaction force (typically provided by one wall of the firing chamber) while the other end of the bubble is unconstrained. However, in the present invention, the baffle plate 32 provides a reaction force to the expanding bubble which is substantially equal to the reaction force provided by the end wall 18A of the firing chamber 22. Therefore, the bubble formed by the inkjet nozzle device 10 is constrained by two opposite walls in the firing chamber 22 and has excellent symmetry compared to the devices described in U.S. Pat. No. 7,780,271 and U.S. Pat. No. 7,857,428. Consequently, ejected ink droplets have minimal skew along both the x- and y-axes.

Moreover, any backflow is minimized because the firing chamber entrances 34 are positioned along the sidewalls of the main chamber 12. During bubble propagation, the majority of the bubble impulse is directed towards the nozzle aperture 26, such that only a relatively small vector component of the bubble impulse reaches the firing chamber entrances 34. Therefore, positioning the firing chamber entrances 34 along the flanks of the baffle plate 36 minimizes backflow during droplet ejection.

Whilst backflow is minimized by the inkjet nozzle device 10, it will be appreciated that backflow cannot be wholly eliminated in any inkjet nozzle device. Backflow can not only affect bubble symmetry and droplet trajectories, but also potentially results in fluidic crosstalk between nearby devices via a pressure wave associated with the backflow of ink. This pressure wave may cause nearby non-ejecting nozzles to flood ink onto the surface of the printhead, resulting in reduced print quality (e.g. by causing misdirection or variable drop size) and/or necessitating more frequent printhead maintenance interventions.

Referring to FIG. 1, fluidic crosstalk between the adjacent nozzle devices 10 is minimized, firstly, by virtue of the tortuous flow path between the devices. Any backflow of ink must flow down through one floor inlet 30, into the ink supply channel 104 and up through another nearby floor inlet 30. Secondly, the pressure wave from any backflow is dampened by the relatively large volume of the ink supply channel 104, which further minimizes the risk of crosstalk between nearby devices.

In a similar manner, fluidic crosstalk during refill of each chamber (which can cause negative pressure in neighboring nozzles and variable drop size) is also minimized.

On the other hand, the accessibility of each device 10 to the bulk ink supply of the ink supply channel 104 via a respective floor inlet 30 advantageously maximizes the refill rate of each main chamber 12. Ink is allowed to flow freely into the antechamber 24 from the ink supply channel 104 via the floor inlet 30, but the momentum of this ink is dampened by the roof and sidewalls of the antechamber 24, as well as the baffle plate 32. Therefore, the antechamber 24 has an important role in minimizing printhead face flooding during chamber refilling compared to, for example, the devices described in U.S. Pat. No. 7,441,865.

The critical refill rate of the firing chamber 22 may be controlled by adjusting the width of the baffle plate 32, thereby narrowing or widening the firing chamber entrances 34. Of course, there will be a trade-off between maximizing firing chamber refill rates versus minimizing backflow during droplet ejection. In this regard, it will be appreciated that the optimum width of the baffle plate 32 may be 'tuned', depending on parameters such as the viscosity and surface tension of ink, maximum ejection frequency, droplet volume etc. In practice, the optimum width of the baffle plate 32 for a particular printhead and ink may be determined empirically. The inkjet nozzle device 10 according to the present invention typically has chamber refill rate suitable for a droplet ejection frequency greater than 10 kHz or greater than 15 kHz, based on a 1.5 pL droplet volume.

It will, of course, be appreciated that the present invention has been described by way of example only and that modifications of detail may be made within the scope of the invention, which is defined in the accompanying claims.

The invention claimed is:

1. An inkjet nozzle device comprising:

a firing chamber having an end wall, opposite sidewalls and a nozzle aperture defined in a roof thereof;

a baffle plate positioned between the sidewalls of the firing chamber, such that a pair of firing chamber entrances are defined between side edges of the baffle plate and the sidewalls;

an elongate heating element bonded to a floor of the firing chamber, the heater element extending longitudinally between the baffle plate and the end wall, wherein:

the baffle plate is wider than the heater element;

a centroid of the heater element coincides with a midpoint between the baffle plate and the end wall; and a surface portion of the baffle plate mirrors an opposite surface portion of the end wall.

2. The inkjet nozzle device of claim 1, wherein the nozzle aperture is elongate having a longitudinal axis aligned with a longitudinal axis of the heater element.

3. The inkjet nozzle device of claim 2, wherein the nozzle aperture is elliptical having a major axis aligned with the longitudinal axis of the heater element.

4. The inkjet nozzle device of claim 1, wherein a centroid of the nozzle aperture is aligned with the centroid of the heater element.

5. The inkjet nozzle device of claim 1 wherein a centroid of the nozzle aperture is offset from the centroid of heater element along the longitudinal axis of the heater element.

6. The inkjet nozzle device of claim 1, wherein the end wall, the sidewalls and the baffle plate are comprised of a same material.

7. The inkjet nozzle device of claim 6, wherein the end wall, the sidewalls and the baffle plate are comprised of a material selected from the group consisting of: silicon oxide, silicon nitride and combinations thereof.

8. The inkjet nozzle device of claim 1, further comprising an antechamber adjacent the firing chamber, the pair of firing chamber entrances receiving ink from the antechamber.

9. The inkjet nozzle device of claim 8, wherein the firing chamber has a larger volume than the antechamber.

10. The inkjet nozzle device of claim 8, wherein a perimeter wall encloses the firing chamber and antechamber, the perimeter wall defining the sidewalls and end wall of the firing chamber.

11. The inkjet nozzle device of claim 8, wherein an ink inlet is defined in a floor of the antechamber.

12. The inkjet nozzle device of claim 1, wherein the heater element has electrodes staked beneath the baffle plate and end wall respectively.

13. An inkjet printhead comprising a plurality of inkjet nozzle devices according to claim 1.

* * * * *